United States Patent [19]

Marzec

[11] Patent Number: 4,995,442

[45] Date of Patent: Feb. 26, 1991

[54] CURTAIN OPENING DEVICE

[76] Inventor: Stanley E. Marzec, 14 Rusholme Drive, Apt. 3, Toronto, Ontario, Canada, M6J 3G9

[21] Appl. No.: 489,119

[22] Filed: Mar. 5, 1990

Related U.S. Application Data

[63] Continuation-in-part of Ser. No. 365,151, Jun. 12, 1989, abandoned.

[30] Foreign Application Priority Data

Jun. 10, 1988 [CA] Canada ..... 569146

[51] Int. Cl.[5] ..... A47H 5/02

[52] U.S. Cl. ..... 160/331; 160/5; 160/7

[58] Field of Search ..... 160/331, 345, 126, 172, 160/5, 7, 1

[56] References Cited

U.S. PATENT DOCUMENTS

| | | | |
|---|---|---|---|
| 1,595,669 | 8/1926 | Kurner | 160/331 X |
| 2,043,981 | 6/1936 | Bickel | 160/331 X |
| 2,788,481 | 4/1957 | Lui et al. | 160/331 X |
| 2,798,194 | 7/1957 | Cantin | 160/331 X |
| 2,962,647 | 11/1960 | Borenstein | 160/5 X |
| 3,096,078 | 7/1963 | Steingass et al. | 160/331 X |
| 3,294,150 | 12/1966 | Thomas | 160/5 |
| 3,294,151 | 12/1966 | Hartley et al. | 160/5 |
| 3,294,152 | 12/1966 | Kuijvenhoven | 160/5 |
| 3,372,599 | 3/1968 | Bratschi | 160/331 X |
| 3,438,423 | 4/1969 | Melull et al. | 160/331 |
| 3,646,985 | 3/1972 | Klann | 160/5 X |
| 3,861,738 | 1/1975 | Whitney | 160/331 X |
| 4,031,944 | 6/1977 | Morrison et al. | 160/331 |
| 4,610,294 | 9/1986 | Anesi et al. | 160/331 |
| 4,727,918 | 3/1988 | Schroeder | 160/5 |
| 4,819,708 | 4/1989 | Onosato et al. | 160/331 |
| 4,864,201 | 9/1989 | Bernot | 160/5 X |
| 4,914,360 | 4/1990 | Hsieh et al. | 160/331 X |

*Primary Examiner*—David M. Purol

*Attorney, Agent, or Firm*—Rogers, Bereskin & Parr

[57] ABSTRACT

A device for opening and closing a closure member, typically a curtain in which a cord is associated with the closure member and has a bight portion located in the first plane and a pair of substantially parallel, spaced first and second reaches located in a second plane spaced from the first plane. The device comprises a drive roller for driving engagement with the bight portion, a reversible electric motor for driving the drive roller, the diameter of the drive roller being larger than the spacing between the parallel reaches. First and second pulleys are provided between the reaches and the bight to allow a change in direction of the cord between the reaches and the bight, the first pulley being rotatable about an axis which is skewed relative to the first and second planes. Thus, the reaches pass around the respective pulleys and when the reaches leave the pulleys the spacing between the reaches is substantially similar to the diameter of the drive roller.

16 Claims, 4 Drawing Sheets

CURTAIN OPENING DEVICE

RELATED APPLICATIONS

This is a continuation-in-part of application Ser. No. 365,151, filed Jun. 12, 1989 now abandoned.

FIELD OF THE INVENTION

This invention relates to a device for opening or closing curtains, blinds and the like. For ease of description the term curtain will be used in this specification to denote closure members generally and including such other items as blinds and the like.

BACKGROUND OF THE INVENTION

Many buildings utilise window coverings of the type which are drawn across the window from a storage position at a side of the window. As in the case of curtains, the covering may fold on itself to occupy a smaller space in the storage position, or as in the case of vertical blinds, the covering may comprise connected vertical strips which may be rotated from to an orientation parallel to the window in the in-use position, to an orientation normal to the window such that they may be brought together in the storage position at the side of the window.

Curtains are normally suspended from rails running adjacent to the upper edge of the window, one edge of the curtain being fixed to the rail and the rest of the curtain being free to move along the rail. In the simplest arrangement, an operator opens or closes the curtains by pulling on the free edge of the curtain. However, this requires handling of the curtain, and the downward pull exerted on the rail increases the likelihood of the curtain jamming in the rail. This would also clearly be unsuitable for window coverings such as vertical blinds. Accordingly, many curtains are provided with lines which are attached to the free edge and pass around a system of pulleys on the rail and the wall adjacent the window to allow an operator to open or close the window by pulling on a vertical line at the side of the window, normally concealed by the curtain.

SUMMARY OF THE INVENTION

According to one aspect of the present invention, there is provided a device for opening and closing at least one closure member, typically a curtain, a cord being associated with the closure member and having a bight portion located in a first plane and a pair of substantially parallel, spaced first and second reaches located in a second plane spaced from the first plane. The device comprises a drive roller for driving engagement with the bight portion, a reversible electric motor for driving the drive roller, the diameter of the drive roller being larger than the spacing between the parallel reaches. First and second pulleys are provided between the reaches and the bight to allow a change in direction of the cord between the reaches and bight, at least the first pulley being rotatable about an axis which is skewed relative to the first and second planes. Thus, the reaches pass around the respective pulleys and when the reaches leave the pulleys the spacing between the reaches is substantially similar to the diameter of the drive roller.

Preferably, further pulleys are provided such that the first reach may pass from the second plane around the first pulley, around the drive roller, around a third pulley, around a fourth pulley and around the second pulley to return to the second plane. The third pulley be mounted such that the angle of contact of the cord with the drive roller is greater than 180°, and the fourth pulley is mounted such as to provide tensioning for the cord.

Preferably also, first and second switches are provided adjacent the respective first and second reaches and are adapted to co-operate with respective actuators provided on the reaches, activation of the electric motor causing movement of the cord to open or close the closure member until one of the actuators operates a respective switch means to deactive the electric motor. The electric motor may be activated manually, or may be linked to a light sensor which automatically activates the electric motor to open or close the closure member on detection of a predetermined light condition.

According to a further aspect of the present invention there is provided a device for opening and closing at least one closure member a cord being associated with the closure member and having bight portion and first and second reaches. The device comprises a drive roller for driving engagement with the bight portion, a reversible electric motor for driving the drive roller, first and second switches each moveable between first and second switching states and normally in the first switching state, first and second stops mounted on a respective first and second reach to operate a respective first and second switch at first and second extreme positions of the closure member, a third switch across an electrical power supply and moveable between first and second switching states, and a first relay having a relay coil and associated first and second connections. To move the closure member in a first direction the third switch is positioned in the first switching state, the first relay coil and the associated connections being a first relay state and the first and second connections of the first relay, the first switch and the reversible electrical motor being in series with the power supply to drive the reversible electric motor in a first direction until the first stop operates the first switch to the first switching state and deactivates the reversible electric motor. To move the closure member in a second direction the third switch is positioned in the second switching state, the first relay coil and the associated connections being in a second relay state and the first and second connections of the first relay, the second switch and the reversible electric motor being in series with the power supply to drive the reversible electric motor in a second direction until the second stop operates the first switch to the second switching state and deactivates the reversible electric motor.

According to a still further aspect of the present invention there is provided a device for the automatic opening and closing of at least one closure member in response to changes in light conditions. A cord is associated with the closure member and has a bight portion and first and second reaches. The device comprises a drive roller for driving engagement with the bight portion, a reversible electric motor for driving the drive roller, first and second switches, each moveable between first and second switching states and normally in the first switching state, first and second stops mounted on respective first and second reaches to operate the respective first and second switches at first and second extreme positions of the closure member, a light sensitive switch, an electrical power supply, and first, third and fourth relays, each having a relay coil, the first relay having first and second connections and the third and fourth relays having first connections. When the light sensitive switch detects a first light condition the device operates to move the closure member in a first direction, the light sensitive switch adopting a first switching state, the third being in a second relay state, the first relay being in the first relay state and the first connector of the third relay, the first and second connectors of the first relay, the first switch and the reversible electric motor being in series with the power supply to drive the reversible electric motor in a first direction until the first stop operates the first switch to the second switching state and deactivates the reversible electric motor. When the light sensitive switch detects a second light condition, the device operates to move the closure member in a second direction, the light sensitive switch adopting a second switching state, the third relay being in a first relay state, the first and fourth relays being in a second relay state and the first and second connections of the first relay, the second switch and the reversible electric motor being in series with the power supply to drive the reversible electric motor in a second direction until the second stop operates the second switch to the second switching state and deactivates the reversible electric motor.

BRIEF DESCRIPTION OF THE DRAWINGS

Preferred embodiments of the present invention will now be described, by way of example, with reference to the accompanying drawings, in which.

DETAILED DESCRIPTION OF THE PREFERRED EMBODIMENTS

Figure 1:
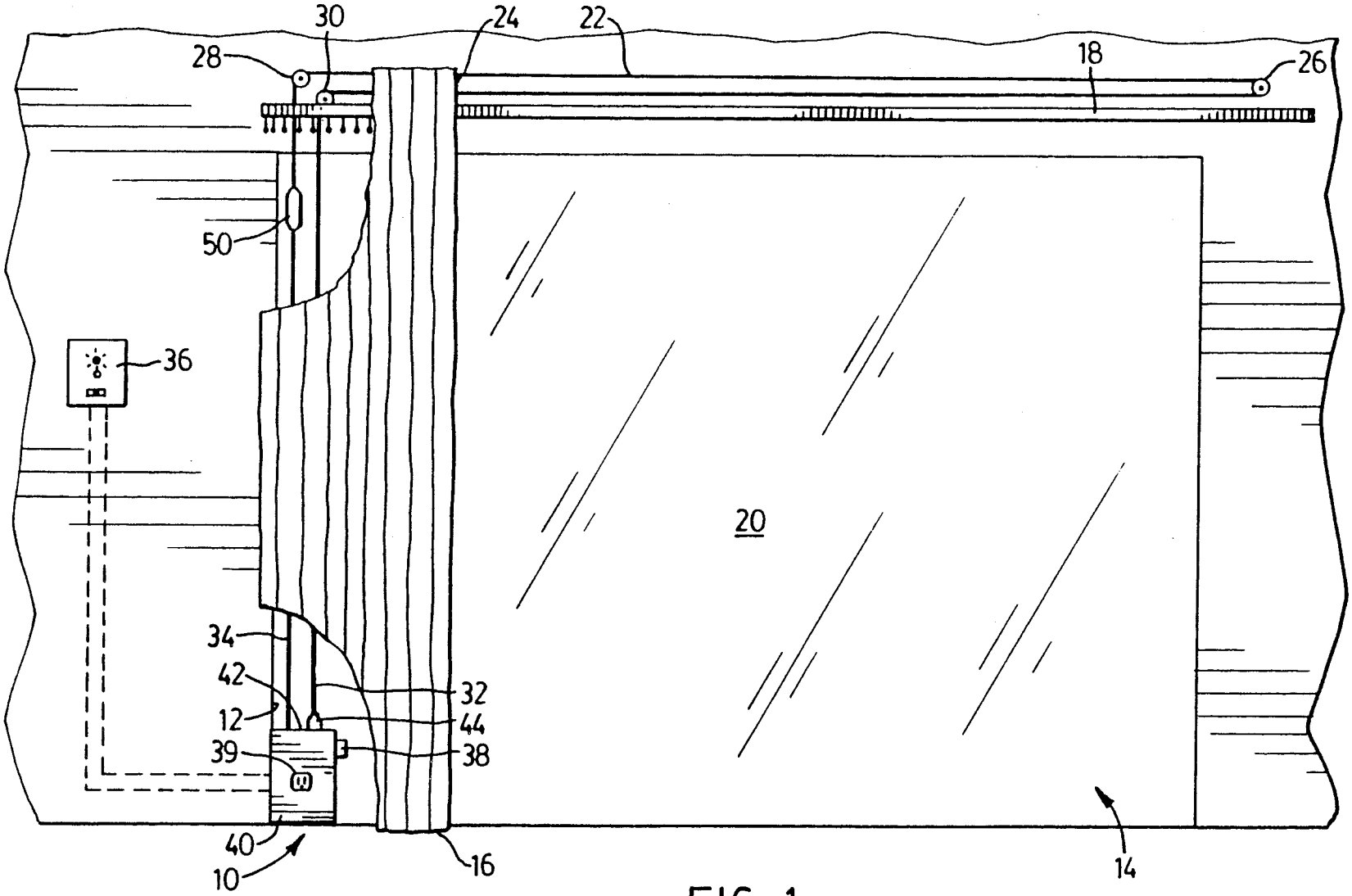
FIG. 1 shows a curtain and a device for opening and closing the curtain in accordance with a preferred embodiment of the present invention, the curtain being shown partly cut away.

Reference is first made to FIG. 1 of the drawings, which shows an exemplary situation for a device in accordance with the present invention. The device 10 is fixed to a wall 12 of a window recess 14 for use in opening and closing a curtain 16 suspended from a curtain rail 18, which extends above a window 20. The curtain 16 is pulled along the rail 18 by means of a cord 22 which is attached to the upper corner 24 of the curtain. The cord 22 extends from the corner 24 over various pulleys 26, 28, 30 to form parallel reaches 32, 34 extending to the device 10. The arrangement is such that pulling on the cord to take in the first reach 32 will cause the curtain to open and pulling on the cord to take in the second reach 34 will cause the curtain to close. The cord 22 is continuous and a bight and a further pulley arrangement is provided within the device 10 such that while one reach 32, 34 is being taken in, the other reach 34, 32 will move in the opposite direction and result in movement of the curtain.

The device 10 may be activated to open or close the curtain 16 by means of a wall-mounted switch 36. Alternatively, a photocontrol switch 38 may be used and set to open the curtain, for example, in the morning, when a predetermined light level is detected, and to close the curtain in the evening, when the light level falls below a predetermined level. A power outlet 39 is provided on the device and is switched on when the curtain is closed, and may be used, for example, to power an interior light. Details of the control circuitry of the device 10 will be described in some detail hereinafter.

It should be noted that the device 10, and the cord 22 and pulleys 26, 28, 30 will normally be concealed by the curtain or be arranged such that they are unobtrustive. The illustrated arrangement is merely exemplary to show the working of the invention. Also, it should be noted that invention is equally applicable to vertical blinds and other forms of window coverings, or indeed any suitable closure member.

Figure 2:
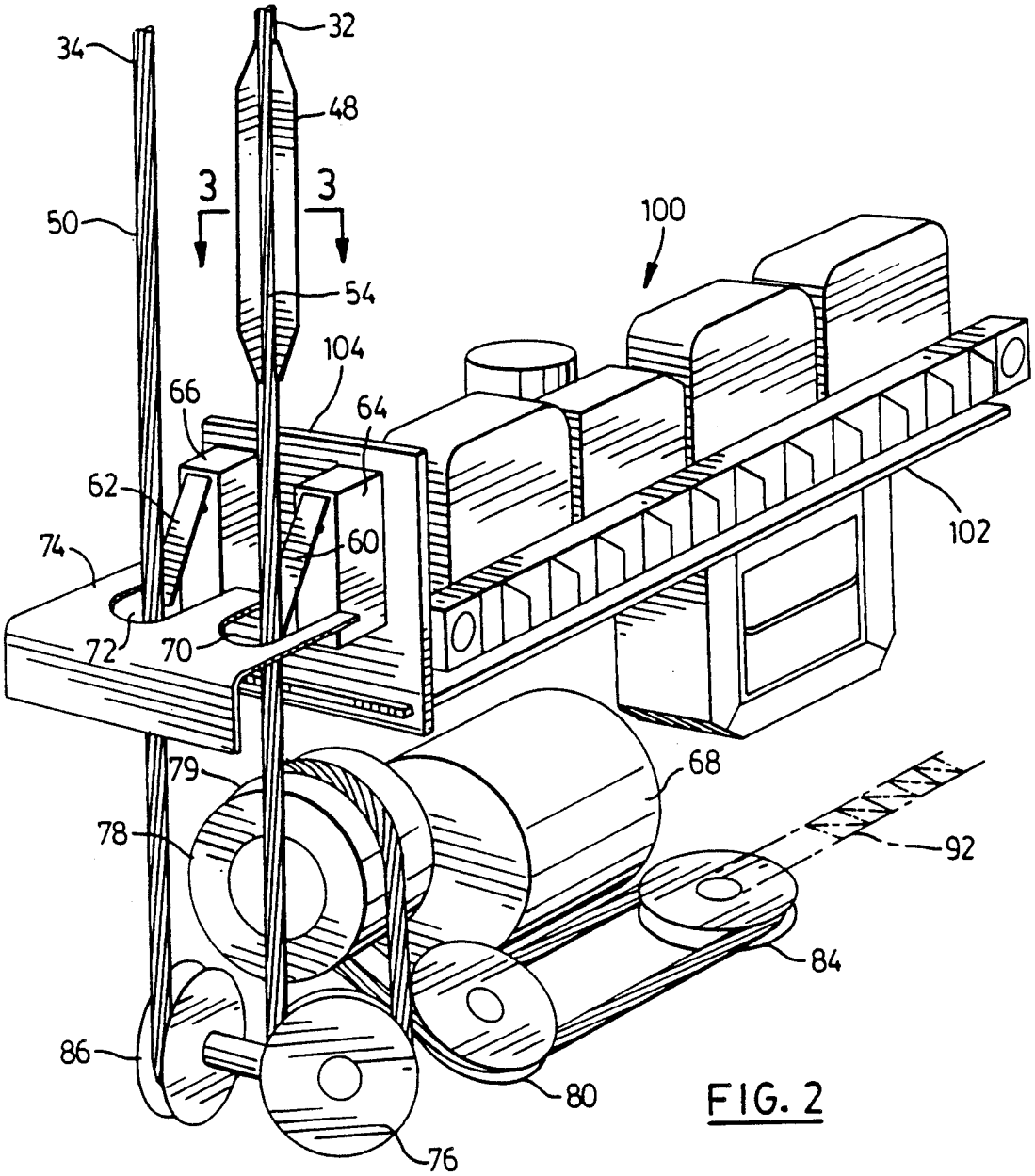
FIG. 2 is a perspective view of the device of FIG. 1, with the casing removed to reveal the internal workings of the device.
Figure 3:
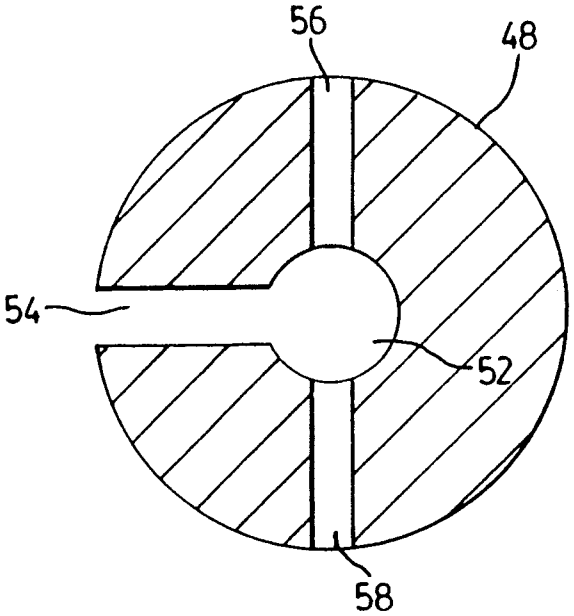
FIG. 3 is an enlarged sectional view on line 3—3 of FIG. 2.

Reference is now made to FIG. 2 of the drawings, which shows the device 10 with the external casing 40 (FIG. 1) removed. The first and second reaches 32, 34 enter the device through apertures 42, 44 provided in the casing 40. The line passes through the device around various pulleys, the purpose of which will be described below. Each of the reaches 32, 34 is provided with respective switch actuators in the form of cams formed of plastic conical-ended cylinders, which shall be referred to as switch actuators 48 and 50 (FIG. 1). FIG. 3 shows a section of one of these actuators 48, from which it will be noted that the actuator 48 includes a central through-bore 52 to accommodate the line, an access slot 54 to allow the operator to be placed on the line, and two opposing transverse bores 56, 58 for receiving screws (not shown) to abut the line and hold the actuator 48 at a desired position on the line.

The actuator 48, 50 are used to operate switch means in the form of respective microswitches 64, 66 which control the operation of an electrical motor means, in the form of a reversible DC electric motor 68. Each microswitch 64, 66 is provided with a spring arm 60, 62 which is mounted at a top edge of the switch and is depressed by an actuator to operate the respective switch. Suitable microswitches are available from Radio Shack under product no. SL-2NW1.

The various parts of the device 10 are mounted to the casing which is secured to the wall of the window recess 12 (FIG. 1). However, for clarity, the individual mountings have not been illustrated.

From FIG. 2 it may be seen that the reaches 32, 34 are aligned to pass in front of the respective microswitches 64, 66. The path of the line is controlled by the positions of the pulleys and also a locating bracket 74, which is mounted to the casing. The bracket 74 defines two channels 70, 72 located at the base of the spring arms 64, 66 and are intended to retain the actuators 48, 50 in contact with the spring arms 64, 66.

The path of the cord around the pulleys in the device will now be described, starting from the microswitch 64 for the first reach 32. From the microswitch 64, the cord passes over a first pulley 76, around a drive roller 78 mounted through a reduction rear arrangement to the drive shaft of the motor 68 to form a bight 79, and up and around a third pulley 80.

From the third pulley 80, the cord extends horizontally towards the rear of the device to pass around a spring-mounted fourth tensioning pulley 84. The cord then extends towards the front of the device and around a second pulley 86 which returns the cord to a vertical orientation. The cord passes from this pulley 86 vertically upwards past the microswitch 66.

Figure 4:
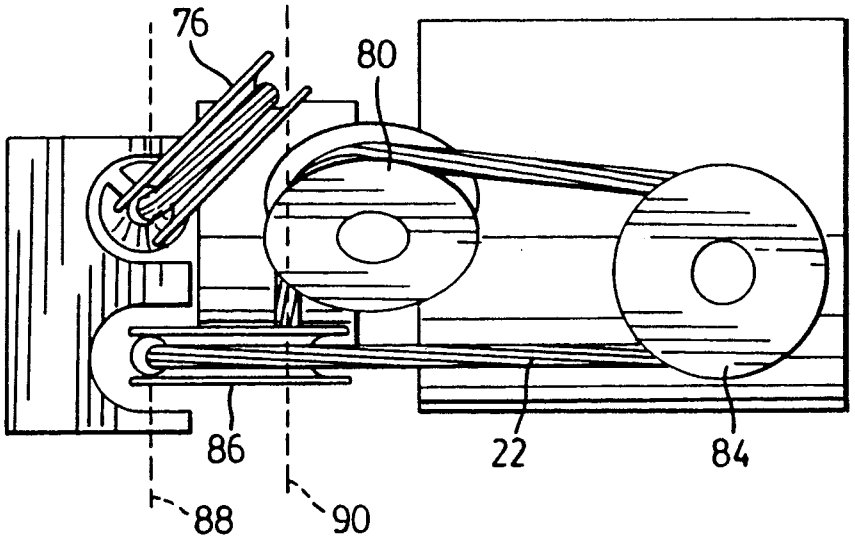
FIG. 4 is a view from below of the pulley configuration of the device of FIG. 1.

The configuration of the pulleys is intended to provide a compact and efficient drive arrangement. It will be noted from FIG. 2 and also from FIG. 4 of the drawings, that the first and second reaches 32, 34 are substantially parallel and are spaced apart, the reaches 32, 34 being located in a second plane 88, while the bight 79 and drive roller 78 are located in a first plane 90 which is parallel to and spaced from the second plane 88. Also, the diameter of the drive roller 78 is greater than the spacing between the reaches 32, 34. To accomodate the larger diameter of the roller 78 the axis of rotation of the first pulley 76 is skewed, at an angle 45°, to the first and second planes 90, 88 and such that the edges of the pulleys 76 are aligned with the first reach 32 and with the periphery of the drive roller 78, such that the cord may pass smoothly between the first reach and the drive roller 78.

The third pulley is configured to provide a substantial contact angle between the cord and the drive roller 78 and is located on a rotational axis which is parallel to the first and second planes 90, 88 and which is at an angle of 45° to the reaches 32, 34 and the portion of the cord between the first pulley and the drive roller such that the angle of contact between the cord and the drive roller 78 is approximately 240°.

The tensioning pulley 84 is mounted rearwardly of the third pulley 80 and is mounted on an adjustable spring tensioner 92 which is in turn mounted to the external casing 40. The rotational axis of the pulley is parallel to the first and second planes 90, 88 and is aligned with the reaches 32, 34.

The rotational axis of the second pulley 86 is parallel to the first and second planes 90, 88 and is perpendicular to the reaches 32, 34.

The provision of elongate actuators 48, 50 and the spring arms 60, 62 allows the device to accommodate over run when the motor 68 is deactivated.

The electrical control components 100 are mounted on a printed circuit board 102 which is mounted to the casing 40. The microswitches 64, 66 are mounted on a vertical second printed circuit board 104 fixed to the front end of the board 102.

Figure 5:
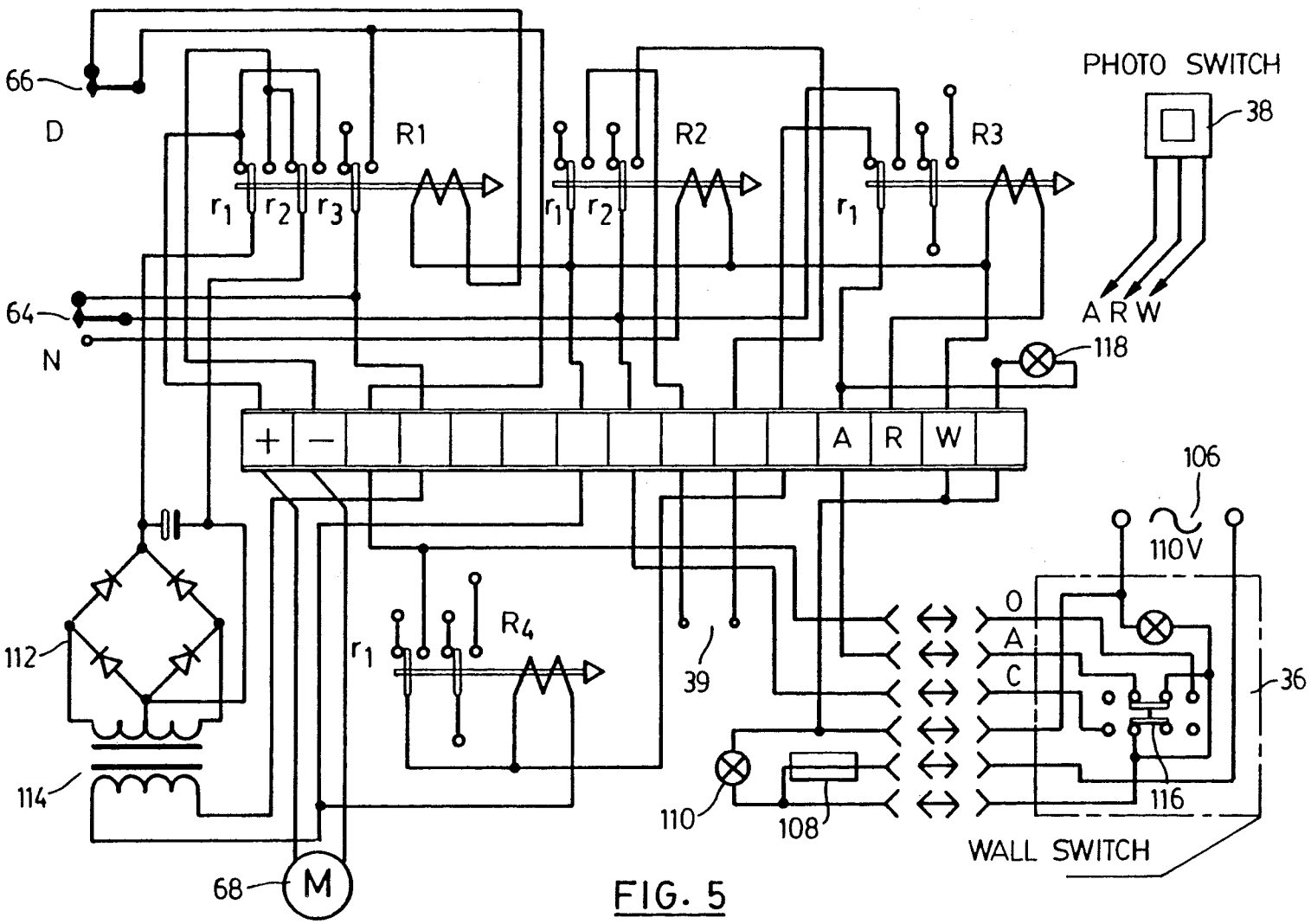
FIG. 5 is a schematic representation of the electrical circuitry of the device of FIG. 1.

Reference is now made to FIG. 5 of the drawings which illustrates, in schematic form, the electrical circuitry of the device 10.

Power for the device 10 is supplied from standard main supply 106, in this case a 110 volt ac supply. The mode of operation of the device 10 is controlled by a three position switch 36 which may be located in open, automatic and closed positions, as will be described.

The control circuitry of the device includes a conventional fuse 108 and an LED 110 and relays R1, R2, R3 and R4, illustrated in the normally open position. Suitable relays are available from Guardian Electric product no. 1390P. The reversible motor 68 is powered via a rectifier 112 which operates in conjunction with a transformer 114. The microswitches 64, 66 are shown in the upper left hand corner of the drawings, and the photocontrol 38 is illustrated in the upper right hand corner of the figure.

As mentioned above, it should be noted that the relays have been illustrated in the normally open position, and the microswitches 64, 66 are shown in the positions assumed when not being affected by the actuators 48, 50.

To manually close the curtain, an operator operates the three way switch 36 such that the moveable contact 116 is moved to the position to the left of the position shown in FIG. 5. In this position, current may flow in series through a circuit which includes the first microswitch 64, the first and second contacts r1, r2 of the first relay R1 and the transformer 114 and rectifier 112. The current from the rectifier 112 passes through the respective first and second contacts r1, r2 of the first relay R1 to the poles of the motor 68, which is caused to rotate in one direction and thus moves the cord 22 to close the curtain. The motor continues to run until the actuator 48 contacts the spring arm 64 to move the microswitch 64 to the "open" position which isolates the transformer 114 from the powers supply and thus deactivates the motor 68.

In the open position, the microswitch 64 directs current through the coil of the second relay r2 which closes the contacts r1, r2 of the relay r2 and provides power for the auxiliary outlet 39.

To open the curtains, the operator moves the three position switch 36 such that the contact 116 is located in the position to the right of the position seen in FIG. 5. Current now flows through the coil of the first relay R1 and the second microswitch 64. Current is supplied to the transformer and rectifier 114, 112 as before, however, the first and second contacts r1, r2 of the first relay R1 are now positioned such that a DC current flows to the opposite poles of the motor 68, such that the motor operates in the opposite direction and thus rotates the drive roller and moves the cord to open the curtains.

Operation of the motor continues until the actuator 50 contacts the spring arm 62 and moves the microswitch 66 to the "open" position which isolates the coil of the first relay R1 and thus isolates the transformer 114, one pole of which is linked to the third contact r3 of the first relay R1.

The coil of the second relay R2 is isolated when the switch 36 is moved from the closed position and thus opens the first and second connections r1, r2 such that the power to the auxiliary outlet 39 is discontinued.

Alternatively, the device 10 can be operated by means of a photocontrol switch 38. For this automatic operating mode, the three position switch 36 is located with the switch contact 116 in the position shown in FIG. 5. To indicate that this mode of operation has been selected a LED 118 is provided which is energized when the switch 36 is in the "automatic" position. A suitable photoswitch is available from Precision Multiple Controls of New Jersey, under product no. A-105W.

On the light level detected by the photocontrol 38 falling below a predetermined level, the photocontrol is polarized which results in the energization of the coil of the third relay R3. This results in the operation of the first contact r1 of the third relay R3 and completion of a circuit including the first microswitch 64 and the first and second connectors r1, r2 of the first relay R1, in series, to drive the electric motor 68 to close the curtain.

The closing continues until the actuator 48 contacts the spring arm 60 and the first microswitch 64 is "opened". This isolates the transformer 114 and thus deactivates the motor 68.

On "opening" of the first microswitch 64 the coil of the second relay R2 is energized such that power is provided to the auxiliary outlet through the first and second contacts r1, r2 of the second relay R2.

When the light detected by the photocontrol switch 38 rises above a predetermined level, the switch is depolarized such that the coil of the third relay R3 is de-energized. Thus, the first contact r1 of the third relay R3 is returned to the normally opened configuration in which the contact is configured to supply power to the coil of the fourth relay R4 and one pole of the transformer 114. Energizing the coil of the fourth relay R4 causes the first contact r1 of the fourth relay R4 to complete a series circuit including the second microswitch 66 and the coil of the first relay R1. The third contact r3 of the first relay R1 then completes the circuit including the transformer 114, and the first and second contacts r1, r2 of the first relay R1 link the outlets of the rectifier 112 and the motor 68 to operate the motor in the opposite direction such that the curtain is opened.

The opening cycle continues until the second actuator 50 contacts the spring arm 62, opening of the second microswitch 66 and breaking the circuit and thus deactivating the motor 68.

To avoid unintentional opening and closing of the curtain a timer may be provided to ensure that a light condition is maintained for, for example, 15 seconds before the switching state of the photoswitch changes.

Thus it may be seen that the devices described provide simple and compact means for opening and closing curtains and the like.

It will be clear to those skilled in the art that the above description are merely exemplary, and that variations and modifications may be made to the devices without departing from the scope of the invention, for example the size of the drive pulley 78 may be altered to change the speed of operation of the devices.

I claim:

1. A device for opening and closing at least one closure member, a cord being associated with the closure member and having a bight portion located in a first plane and a pair of substantially parallel, spaced first and second reaches located in a second plane spaced from said first plane, the device comprising a drive roller for driving engagement with the bight portion, reversible electric motor means for driving the drive roller, the diameter of the drive roller being larger than the spacing between the parallel reaches, and first and second pulleys between the reaches and the bight to allow a change in direction of the cord between the reaches and bight, at least a first pulley being rotatable about an axis skewed relative to the first and second planes.

2. The device of claim 1, wherein the axis of rotation of the second pulley is perpendicular to the second plane of the reaches.

3. The device of claim 2, wherein the first plane of the drive roller circumference and the bight is located spaced from and parallel to the second plane of the reaches.

4. The device of claim 3, wherein third and fourth pulleys are provided, the third pulley being adapted to receive cord from or supply cord to the drive roller, the angle of contact of the cord on the drive roller between the portion of cord extending from the first pulley to the drive roller and the portion of cord extending from the drive roller to the third roller being greater than 180°, and the cord extending from the third pulley around the fourth pulley, and from the fourth pulley to the second pulley.

5. The device of claim 4, wherein the fourth pulley is adjustably mounted and is adapted to apply tension to the cord.

6. The device of claim 5, wherein the axis of the second pulley is parallel to the second plane and perpendicular to the axis of rotation of the drive roller, the axis of the third pulley is parallel to the second plane and skewed relative to the axis of the second pulley, and the axis of the fourth pulley is parallel to the second plane and parallel to the reaches.

7. The device of claim 6, wherein first and second switch means are provided adjacent the respective first and second reaches and are adapted to co-operate with respective actuators provided on the reaches, activation of the electric motor means causing movement of the reaches to open or close the closure member until one of the acutators operates a respective switch means to deactivate the electric motor means.

8. The device of claim 7, wherein each switch means includes a spring arm which extends into the path of the respective actuator, deflection of the spring arm by the actuator operating the respective switch means.

9. The device of claim 8, wherein guide means are provided for the reaches and actuators adjacent the switch means, the guide means retaining the actuators in contact with the spring arm.

10. The device of claim 9, wherein each actuator is in the form of an elongate cam.

11. A device for opening and closing at least one closure member, a cord being associated with the closure member and having a bight portion and first and second reaches, the device comprising a drive roller for driving engagement with the bight portion, reversible electric motor means for driving the drive roller, first and second switch means each moveable between first and second switching states and normally in the first switching state, first and second stop means mounted on a respective first and second reach to operate a respective first and second switch means at first and second extreme positions of the closure member, third switching means across an electrical power supply and moveable between first and second switching states, and a first relay means having a relay coil and associated first and second connections, to move the closure member in a first direction the third switching means being positioned in the first switching state, the first relay coil and the associated connections being in a first relay state and the first and second connections of the first relay means, the first switch means and the reversible electric motor means reversible being in series with the power supply to drive the electric motor means in a first direction until the first stop means operates the first switch means to the second switching state and deactivates the reversible electric motor means, and to move the closure member in a second direction the third switching means being positioned in the second switching state, the first relay coil and the associated connections being in a second relay state and the first and second connections of the first relay means, the second switch means and the reversible electric motor means being in series with the power supply to drive the reversible, electric motor means in a second direction until the second stop means operates the first switch means to the second switching state and deactivates the reversible electric motor means.

12. The device of claim 11, wherein the reversible electric motor means is in the form of a dc motor and the electrical power supply provides ac current, the first relay means being provided with a third connection, and further including a rectifier and an associated transformer, with the third switching means in the first switching state the poles of the transformer being in series with the power supply and the poles of the rectifier being in series with the first and second connections of the first relay, and with the third switching means in the second switching state the poles of the transformer being in series with opposite poles of the power supply, one of the poles of the transformer being in series with the third connection of the first relay, and the poles of the rectifier being in series with first and second connections of the first relay means which, in the second relay configuration, are in series with opposite poles of the reversible electric motor.

13. The device of claim 11, and further comprising a second relay means having a relay, coil and associated first and second connections in series with an auxiliary power outlet, with the third switch means in the first position and the first switch means in the second position, the relay coil and the associated switches of the second relay means being in a second relay state and the first and second connections of the second relay means and the first switch means being in series to provide electrical power at the auxiliary power outlet.

14. A device for the automatic opening and closing of at least one closure member in response to changes in light conditions, a cord being associated with the closure member and having a bight portion and first and second reaches, the device comprising a drive roller for driving engagement with the bight portion, reversible electric motor means for driving the drive roller, first and second switch means, each moveable between first and second switching states and normally in the first switching state, first and second stop means mounted on a respective first and second reach to operate a respective first and second extreme positions of the closure member, light sensitive switching means across an electrical power supply, and first, third and fourth relay means, each having a relay coil, the first relay means having first and second connections and the third and fourth relay means having first connectors, when the light sensitive switch means detects a first light condition the device operating to move the closure member in a first direction, the light sensitive means adopting a first switching state, the third relay means being in a second relay state, the first relay means being in a first relay state and the first connector of the third relay means, the first switch means and the reversible electric motor means being in series with the power supply to drive the reversible electric motor means in a first direction until the first stop means operates the first switch means to the second switching state and deactivates the reversible electric motor means, and when the light sensitive switch means detects a second light condition, the device operating to move the closure member in a second direction, the light sensitive switch means adopting a second switching state, the third relay means being in a first relay state, the first and fourth relay means being in a second relay state and the first and second connections of the first relay, the second switch means and the reversible electric motor means being in series with the power supply to drive the reversible motor electric motor means in a second direction until the second stop means operates the second switch means to the second switching state and deactivates the reversible electric motor means.

15. The device of claim 14, wherein the reversible motor means is in the form of a dc motor and the electrical power supply provides ac current, the first relay means being provided with a third connection, and further including a rectifier and an associated transformer, with the light sensitive switch means in the first switching state the poles of the transformer being in series with the power supply and the poles of the recitifier being in series with the first and second connections of the first relay, and with the light sensitive switch means in the second switching state the poles of the transformer being in series with opposite poles of the power supply, one of the poles of the transformer being in series with the third connection of the first relay, and the poles of the rectifier being in series with first and second connections of the first relay means which, in the second relay configuration, are in series with opposite poles of the reversible electric motor.

16. The device of claim 14, and further comprising a second relay means having a relay, coil and associated first and second connections in series with an auxiliary power outlet, with the light sensitive switch means in the first position and the first switch means in the second position, the relay coil of the associated switches of the second relay means being in a second relay state and the first and second connection of the second relay means and the first switch means being in series to provide electrical power at the auxiliary power outlet.

* * * * *